US008302664B2

(12) United States Patent
Stavenow et al.

(10) Patent No.: US 8,302,664 B2
(45) Date of Patent: Nov. 6, 2012

(54) STRAND GUIDE, IN PARTICULAR FOR A CONTINUOUS CASTING INSTALLATION FOR STEEL SLABS

(75) Inventors: Axel Stavenow, Duesseldorf (DE); Axel Weyer, Wuppertal (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 12/736,736

(22) PCT Filed: May 26, 2009

(86) PCT No.: PCT/EP2009/003711

§ 371 (c)(1),
(2), (4) Date: Nov. 2, 2010

(87) PCT Pub. No.: WO2009/144001

PCT Pub. Date: Dec. 3, 2009

(65) Prior Publication Data

US 2011/0056803 A1 Mar. 10, 2011

(30) Foreign Application Priority Data

May 28, 2008 (DE) ..... 10 2008 025 548

(51) Int. Cl.
*B22D 11/128* (2006.01)

(52) U.S. Cl. ..... 164/442; 164/448

(58) Field of Classification Search ..... 164/441, 164/442, 447, 448, 484
See application file for complete search history.

(56) References Cited

U.S. PATENT DOCUMENTS

| | | | | |
|---|---|---|---|---|
| 3,550,675 | A * | 12/1970 | Hess et al. | 164/442 |
| 3,613,771 | A | 10/1971 | Bieri | |
| 3,707,184 | A * | 12/1972 | Burkhardt et al. | 164/448 |
| 4,058,154 | A * | 11/1977 | Streubel et al. | 164/484 |
| 4,290,478 | A | 9/1981 | Kagerhuber | |
| 4,316,494 | A * | 2/1982 | Scheurecker | 164/448 |
| 6,234,301 | B1 | 5/2001 | von Wyl | |
| 6,568,459 | B2 * | 5/2003 | Ashburn | 164/413 |
| 6,568,460 | B1 * | 5/2003 | Kneppe et al. | 164/442 |
| 2002/0070000 | A1 * | 6/2002 | Weyer et al. | 164/413 |
| 2004/0026066 | A1 * | 2/2004 | Rahmfeld et al. | 164/452 |

FOREIGN PATENT DOCUMENTS

| | | |
|---|---|---|
| DE | 20 36 266 | 1/1972 |
| DE | 102 25 924 | 11/2003 |
| GB | 964658 | 7/1964 |
| JP | 600-83758 | 5/1985 |

* cited by examiner

*Primary Examiner* — Kevin P Kerns
(74) *Attorney, Agent, or Firm* — Abelman, Frayne & Schwab

(57) ABSTRACT

A strand guide (1) for a steel slab continuous casting installation includes a number of segments (2) with support elements (6, 7) which support a strand (3) on two opposite sides (4, 5). The support elements (6, 7) are arranged in a lower frame (8) and an upper frame (9) which are formed to guide the strand (3) in a conveying direction (F). The upper and the lower frames (8, 9) are adjusted relative to one another in the conveying direction (F) with adjusting elements (10).

2 Claims, 4 Drawing Sheets

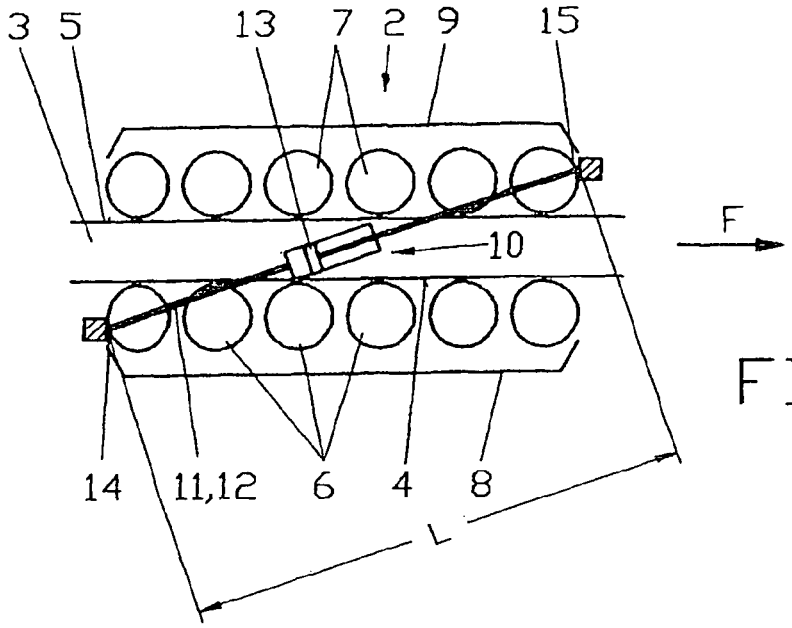
FIG.4
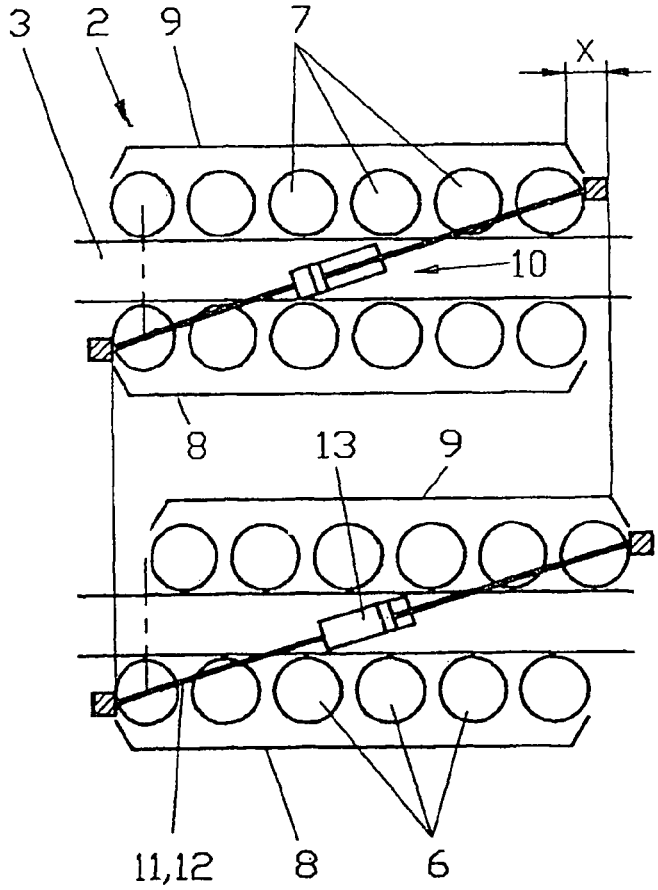
FIG.5a
FIG.5b

STRAND GUIDE, IN PARTICULAR FOR A CONTINUOUS CASTING INSTALLATION FOR STEEL SLABS

RELATED APPLICATION

This application is a National Stage application of International application PCT/EP2009/003711 filed May 26, 2009 that claims priority of German application 10 2008 025 548 filed May 28, 2008.

BACKGROUND OF THE INVENTION

1. Field of the Invention

The invention relates to a strand guide, in particular for a steel slab continuous casting installation having a plurality of segments which support a strand on two opposite sides with support elements, wherein the support elements are arranged in a lower frame and an upper frame and wherein the frames are formed for guiding the strand in a conveying direction.

2. Description of the Prior Art

A strand guide for a continuous casting installation of this type is disclosed in EP 0 963 263 B1. The strand guide has a plurality of support segments which form a casting bow having opposite rows of guide and drive rollers.

The rollers are supported in an upper frame and a lower frame. At one end of a frame, there are arranged two guide rods equidistantly spaced from the central axis. This connection guide rod concept of segments is used in continuous casting installations, i.e., for strand guidance. The connection guide rods are arranged in a segment on each side of the segment as guide means of the upper frame.

Such a solution, can be seen in FIGS. 2 and 3 which show a plan view and a side view of a segment of a strand guide. The segment 2 of the strand guide has a lower frame 8 and an upper frame 9 which are provided with respective support, elements in form of rollers 6 and 7. The rollers 6, which are arranged in the lower frame 8, guide the lower side 4 of the cast strand 3, the rollers 7, which are arranged in the upper frame 9, guide, correspondingly, the upper side 5 of the cast strand. The upper frame 9 is connected with the lower frame 8 by two guide rods 11 and 12 which displace the upper frame 9 relative to the lower frame 8.

A similar solution is shown in DE 102 25 924 C2. Here, also, the frames are connected with each other by connection means which here can be formed as spring strips. A further similar solution is disclosed in DE-AS 1 171 119.

The drawback of the known solutions, when connection guide rods are used, consists in that the support of the strand by rollers after mounting of the segment is not changeable which is unfavorable with regard to distribution of the strand support with rollers or bending points or straightening points dependent on the cast thickness format. Further, a so-called bulging effect can be easily produced in the meniscus and which is possible, at fixed roller spacings and roller positions, as a result retroactive effect of strand displacement.

A further negative effect of known installations consists in that mounting and dismounting of a segment, which is required from time to time, is problematic because of space ratios, only little place is available for removal or installation of a frame.

Finally, a further drawback consists in that after mounting of a segment, the precise alignment of the upper frame with the lower frame becomes fixed. Changing this alignment, which sometimes is desirable, can be brought off with much difficulty.

Accordingly, an object of the present invention is to so improve a strand guide of the type described above so that the above-mentioned drawbacks are eliminated or prevented. A better strand support with rollers should become possible to achieve a better support, bending and/or straightening condition. Further, bulging effect should be eliminated. Mounting and dismounting conditions of segments can likewise be improved. Finally, it should be possible to achieve a precise alignment of the upper and lower frames with simple means.

SUMMARY OF THE INVENTION

The solution, which permits to achieve the object of the invention, is characterized in that means is available with which the upper and lower frames can be adjusted relative to each other in the conveying direction.

This means includes, according to an advantageous embodiment, at least two bar-shaped guide rods which are secured, respectively, to the upper and lower frames, with the guide rods each having an actuator for changing the effective length of the guide rod. The actuator can be integrated in the guide rod between opposite ends of the guide rod. Alternatively, it is also possible to arrange the actuator in the connection region of the guide rod with the frame.

According to an embodiment of the invention, the actuator is formed as a hydraulic piston-cylinder system. Alternatively, it is also possible to form the actuator as a mechanical length-adjusting element. In this case, it is contemplated to provide an actuator having a threaded spindle system driven by an electric motor.

The at least two actuators in the at least two guide rods can be connected with control or regulation means for independent control of an actuator. Thereby, in addition to an advantageous symmetrical actuation of actuators, also an asymmetrical actuation is possible in order to be able to undertake special adjustment of the upper frame relative to the lower frame.

The support elements advantageously are formed as driven and non-driven rollers rotatably supported in a frame. The segments advantageously form a casting bow. They can, however, be used in vertical and horizontal strand guide regions.

With the solution according to the invention, a predetermined position of the upper rollers relative to the lower rollers, which is determined by a predetermined length of the guide rod, can be variably changed. Thereby, the following possibilities of influencing the strand guide segments can be easily realized.

A variable displacement of strand support points of the upper rollers relative to the lower rollers is possible. This results in a desired distribution or displacement of strand support points of the rollers, among others, bending points or straightening points dependent, e.g., on the cast thickness format. Thereby, an improved support, bending or straightening condition can be achieved.

The so-called bulging effect in the meniscus, which can take place as a result of a retroactive effect of strand displacement at fixed roller spacings and roller positions of the upper frame, can be prevented. By adjustment of the guide rod length and, thereby, of the strand guide geometry, roller tracks or roller positions can be adjusted. This leads, with a corresponding setting and connected therewith, prevention of the bulging effect in the meniscus, to a stable casting operation.

The mounting and dismounting conditions of segments or their frames can be noticeably improved. The upper frames of adjacent segments, i.e., the upper frames of segments located in front of or behind a mountable or dismountable segment, can displace these segments by a change of the guide rod length and, in effect, in such a position that more space is available for removing or inserting a frame of a segment located between both adjacent segments. This is particularly very advantageous for bending, deflecting and straightening segments.

Finally, it is also possible to undertake a change of separate guide rod lengths of a segment, i.e., to change the lengths of both sidewisely arranged guide rods not by the same amount but differently. Thereby, the normal alignment of the upper frame relative to the lower frame can be changed by changing the guide rod length. Thereby, alignment errors of the frames and in already mounted segment can be simply eliminated. On the other hand, it is also possible to undertake a purposeful desired non-uniform adjustment of frames relative to each other, e.g., a desirable non-central displacement of the upper frame.

BRIEF DESCRIPTION OF THE DRAWINGS

An embodiment of the invention is shown in the drawings. The drawings show:

FIG. 4 in the view according to FIG. 3, a segment of the strand guide according to an embodiment of the present invention;

FIG. 5*a* and FIG. 5*b* the segment according to FIG. 4 in a normal position of segment frames relative to each other (FIG. 5*a*) and in a displaced position of the upper frame relative to the lower frame (FIG. 5*b*), wherein the segments are shown in a position in which they are located beneath each other and are aligned;

DETAILED DESCRIPTION OF THE PREFERRED EMBODIMENT

Figure 1:
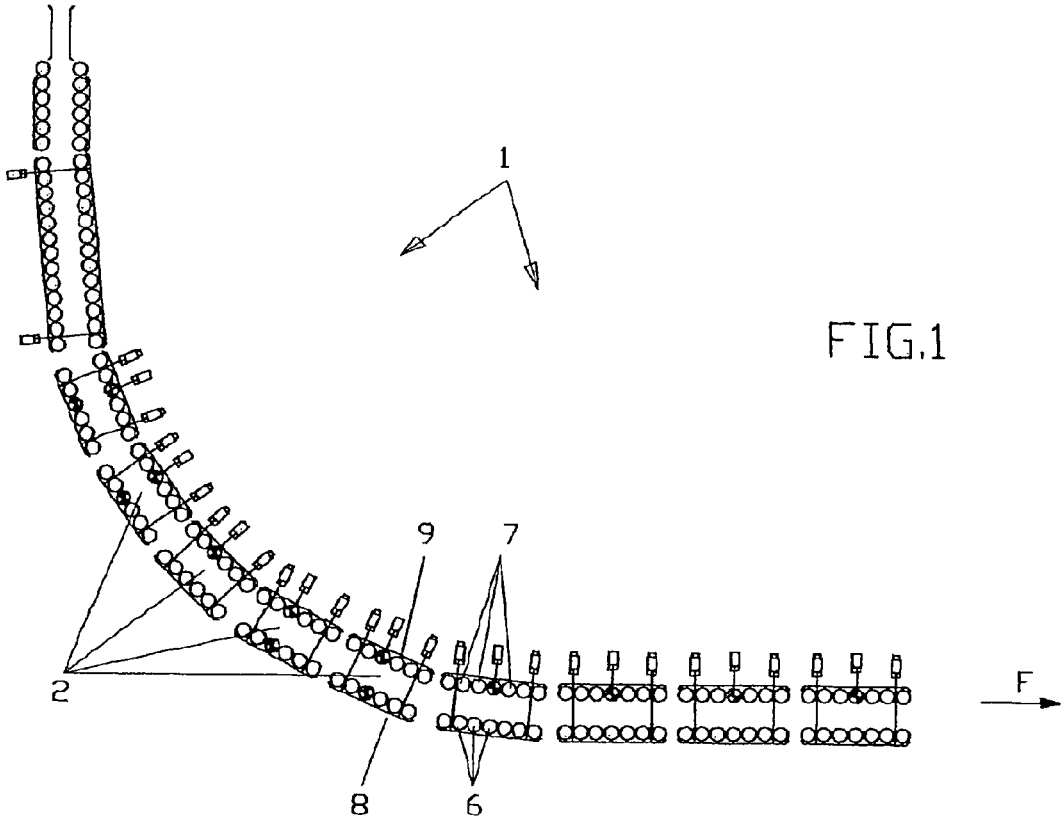
FIG. 1 a side schematic view of a casting bow of a strand guide of a continuous casting machine.

FIG. 1 shows a casting bow of a strand guide 1 of a continuous casting machine. As known, the casting bow consists of a number of segments 2 which are so positioned relative to each other that a bow-shaped path for a cast strand (not shown here) is formed for deflecting it behind a mold from a vertical to a horizontal. Each segment 2 has, as essential components, two frames 8 and 9, namely, a lower frame 8 and an upper frame 9 in which support elements 6, 7 in form of rollers are mounted. The rollers 6, 7 can be driven or not driven, with a frame 8, 9 being able to contain both types of rollers. Thereby, a path in displacement direction F is defined for the cast strand.

Figure 2:
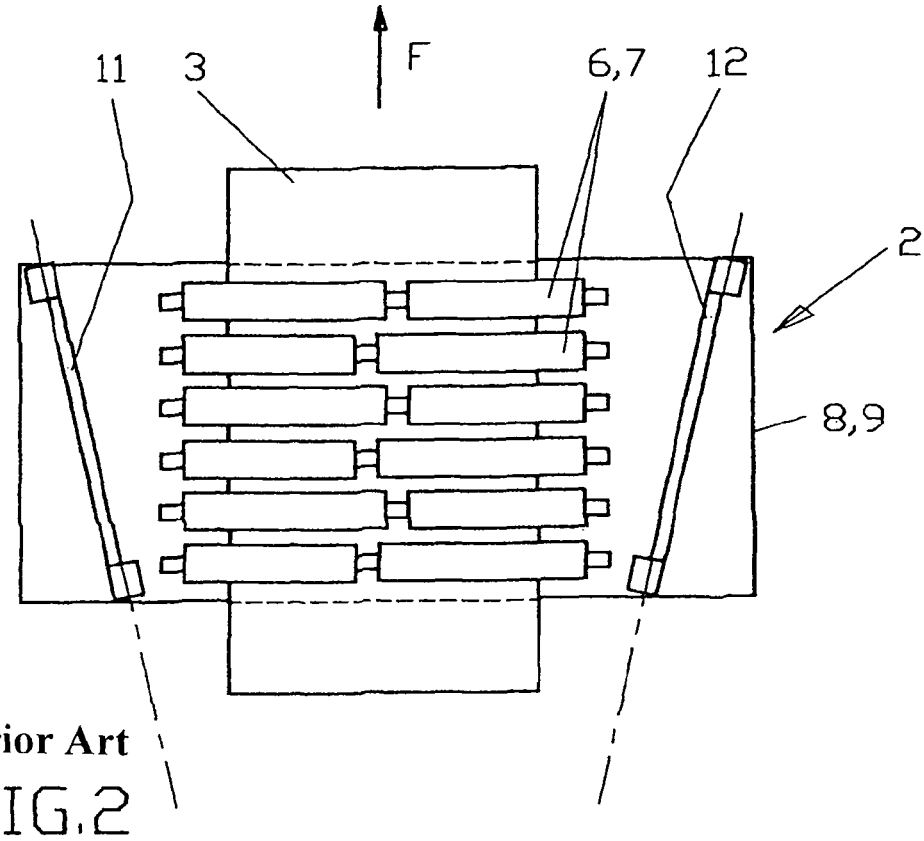
Prior Art FIG.2
FIG. 2 a plan view of a segment of the strand guide according to the state of the art.

The construction of a segment 2 according to an embodiment of the invention is shown in FIG. 4. It is provided that the upper frame 9 is displaced relative to the lower frame 8 by two, sidewisely arranged, guide rods 11 and 12, for illustration of which, reference is made to the preceding FIG. 2 and FIG. 3.

Figure 3:
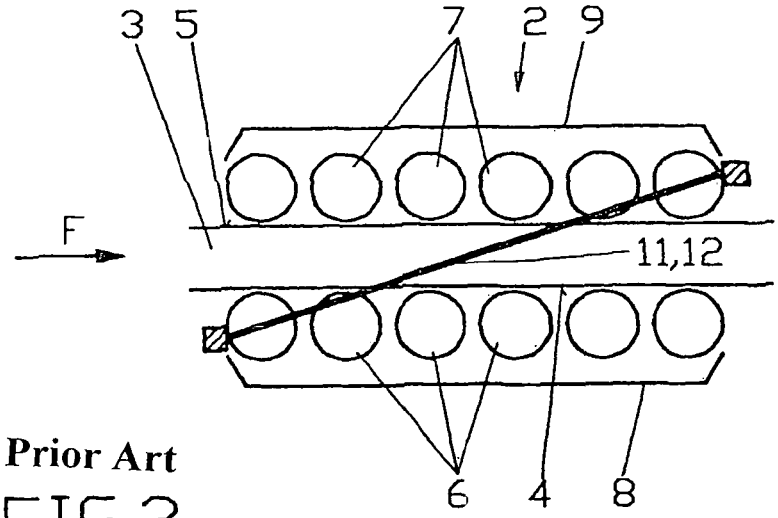
Prior Art FIG.3
FIG. 3 a side view of a segment of the strand guide according to FIG. 2, i.e., according to the state of the art.

In distinction from the known solution according to FIG. 3, it is however, provided that means 10 is available with which the upper and lower frames 8, 9 can be adjusted relative to each other in the conveying F. In the shown embodiment, this is realized by a respective actuator 13 that is integrated in the bar-shaped guide rods 11 and 12. Here, it is shown as a piston-cylinder unit arranged in the guide rod 11, 12.

The guide rods 11, 12 have and effective length L that defines the distance between opposite ends 14 and 15 of the guide rod 11, 12 at which it is pivotally attached to the frame.

As shown in FIG. 5, thereby, a specific adjustment can be undertaken: in FIG. 5*a*, the segment is seen in a normal position, i.e., the upper frame 9 is located relative to the lower frame 8 in an initial position, i.e., the frames 8, 9 are positioned one above the other and are aligned.

If the actuators 13 are actuated, the displaced position can, meanwhile, be adjusted, as shown in FIG. 5*b*. The effective length of the guide rod 11, 12 is here increased with respect to FIG. 5*a* which results in displacement of the upper frame 9 relative to the lower frame 8 by a distance x in the conveying direction (at the same thickness of the strand 3). It is shown that the displacement of the upper frame 9 by a distance x in the conveying direction took place (in FIG. 5*b*, to the right); in the same way, by shortening the effective length of the guide rod 11, 12, the displacement of the upper frame 9 in a direction opposite the conveying direction takes place (in FIG. 5*b*, to the left).

Figures 6A, 6B:
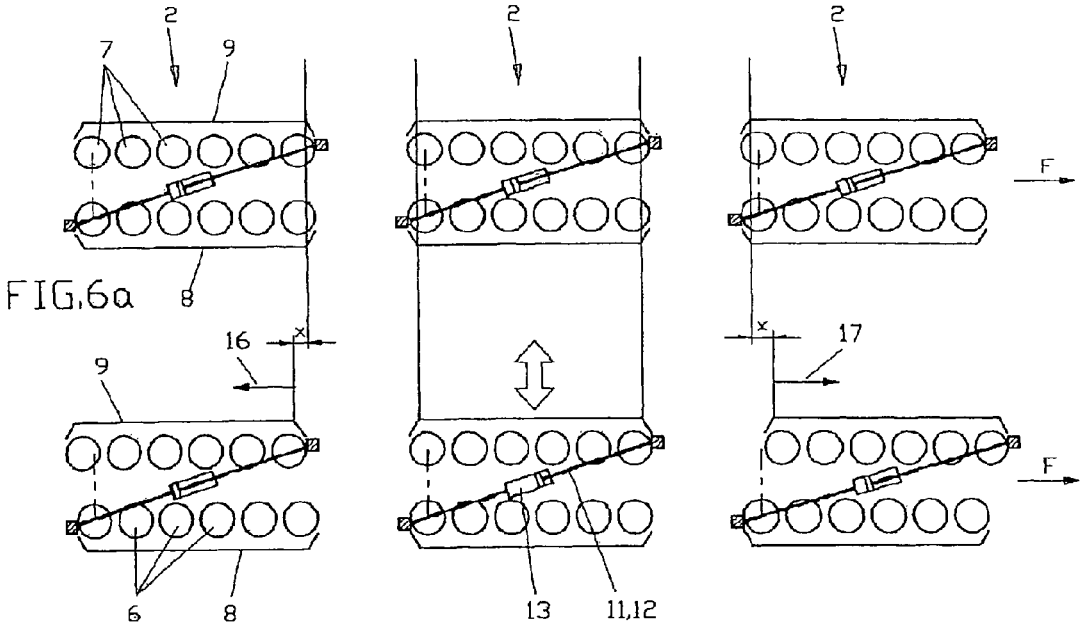
FIG. 6*a* and FIG. 6*b* three adjacent segments of the strand guide in a normal position of segment frames relative to each other (FIG. 6*b*), and in a mounting or dismounting position (FIG. 6*b*), wherein the segments are shown in a position in which they are located beneath each other and are aligned.

A possible use of this effect is illustrated in FIGS. 6*a* and 6*b*. Here, two adjacent segments 2 are shown schematically in a normal position (FIG. 6*a*) and in a mounting or dismounting position (FIG. 6*b*). For mounting or dismounting of a segment or a portion of same, the upper frame 9 of the mentioned (left) segment 2 is displaced in a direction opposite the conveying direction F, i.e., the upper frame 9 of this segment 2 is displaced to the left by a displacement distance x, and the guide rods 11, 12 are shortened by the actuators 13. Correspondingly, the frame 9 of the following (right) segment 2 is displaced in the conveying direction F, i.e., the upper frame 9 of this segment 2 is displaced to the right by a displacement distance x, and the guide rod 11, 12 has its length increased by the actuator 13. As a result, the upper frame 9 of the left segment 2 will be displaced to the left by a displacement 16, and the upper frame 9 of the right segment 2 will be displaced to the right by displacement 17.

Thereby, an increased mounting or dismounting space L (by magnitude 2×) is available for the middle segment 2 between the left and right segments 2. While the right and the left segments remain in their displacement positions 16, 17 in the continuous casting installation, the middle segment can be mounted or dismounted in a more simple manner then up to now.

The integration of the length adjustability of the guide rods 11, 12 provides the above mentioned advantages. The adjustment of the length L of the guide rods 11, 12, can be carried out on each side of the segment 2 independently from each other, i.e., in particular, differently, so that a side-specific alignment of the upper frame 9 relative to the lower frame 8 can be carried out.

For adjustment of the actuator 13, any system can be used. According to one embodiment of the invention, a hydraulic cylinder-piston system is used. However, it is equally possible to use an electrical system, e.g., a threaded spindle or any other mechanical drive and an electric motor for driving the same.

The actuator 13 can be arranged in the guide rod 11, 12, as shown in the discussed embodiment, between both ends 14, 15 of the guide rod. However, it is equally possible to provide the actuator 13 in an end-side region of the guide rod 11, 12, i.e., in the connection region of the guide rod 11, 12 with a respective frame 8, 9.

The adjustment of the length L of the guide rod 11, 12 causes a (parallel) displacement of the roller track of the upper frame 9 relative to the roller track of the lower frame 8. The displacement takes place, as it has already been discussed above, in the casting direction or in an opposite direction. The adjustment, however, can be used (at asymmetrical actuation of both actuators 13 of both guide rods 11 and 12) for a side-specific alignment of the upper frame 9 relative to the lower frame 8.

The adjustment of the effective length of the guide rod 11, 12 can be carried or using control or regulation means. With a hydraulic form of the actuator 13, position regulation of the hydraulic cylinder, of a hydraulic cylinder with internal or external stops, of a pre-stressed hydraulic cylinder (e.g., with plate springs), and/or of a hydraulic-piston-cylinder can take place.

The invention particularly advantageously can be used in slab or thin slab casting installations with vertical, bent, arched, straight and horizontal segments.

REFERENCE NUMERALS

1 Strand guide
2 Segment
3 Strand
4 Strand side
5 Strand side
6 Support element (Roller)
7 Support element (Roller)
8 Lower frame
9 Upper frame
10 Adjustment means
11 Bar-shaped guide rod
12 Bar-shaped guide rod
13 Actuator
14 Guide rod end
15 Guide rod end
16 Displacement
17 Displacement
F Conveying direction
L Effective length
x Distance

The invention claimed is:

1. A strand guide for continuous casting of steel slabs, comprising a plurality of segments arranged one after another in a casting direction of a strand, each segment having a lower frame and an upper frame located on opposite sides of the strand; a plurality of support elements formed as rollers and arranged in the lower frame and the upper frame for supporting and guiding the strand; and means for varying alignment of the upper and lower frames relative to each other and in the strand casting direction during casting of the strand for varying position of strand support points of the upper rollers relative to the position of strand support points of the lower rollers in the casting direction in accordance with the strand thickness to provide for optimal distribution of bending and straightening supports points in the casting direction, whereby optimal bending and straightening conditions are achieved, wherein the varying alignment means comprises at least two-bar-shaped guide rods, with each guide rod being secured at opposite ends thereof to the lower and upper frames, respectively, at respective attachment points of the lower and upper frames located on opposite ends of a diagonal, each guide rod having an actuator arranged between the two opposite ends of the guide rod for varying in an effective length of the guide rod for varying the alignment of the upper and lower frames in the casting direction.

2. A strand guide according to claim 1, wherein the actuator is formed as a hydraulic piston-cylinder system.

* * * * *